United States Patent [19]

Bricker

[11] 4,129,943

[45] Dec. 19, 1978

[54] CHAIN SAW BAR TIGHTENER

[76] Inventor: Norman C. Bricker, R.R. #2, Coleman Rd., Courtenay, B. C., Canada, V9N 5M9

[21] Appl. No.: 854,732

[22] Filed: Nov. 25, 1977

[51] Int. Cl.[2] ..... B27B 17/14

[52] U.S. Cl. ..... 30/386; 83/816

[58] Field of Search ..... 30/382, 383, 384, 385, 30/386, 387; 83/816

[56] References Cited

U.S. PATENT DOCUMENTS

| | | | |
|---|---|---|---|
| 2,109,702 | 3/1938 | Lange | 30/385 |
| 2,718,908 | 9/1955 | Kiekhaefer | 30/386 X |
| 3,267,973 | 8/1966 | Beard | 30/386 |
| 3,636,995 | 1/1972 | Newman | 30/386 |
| 3,866,320 | 2/1975 | Progl | 30/386 |

*Primary Examiner*—Jimmy C. Peters

*Attorney, Agent, or Firm*—Daniel Jay Tick

[57] ABSTRACT

A disc has an axial bore therethrough. A semiannular slot having a diameter smaller than that of the disc is formed through the disc with its ends on a diameter of the disc. One end of the slot is adjacent the circumference of the disc and the other end thereof is adjacent the axial bore between the bore and a point diametrically opposite that adjacent the one end of the slot. A plurality of spaced accommodation slots extend radially in mutually spaced relation in the area of approximately half the circumference of the disc. The disc is rotatably mounted for rotation via a stud passing through the slot of the chain bar of a chain saw and affixed to the housing casting of the saw. A bar pin passes through the slot of the disc and is affixed to the chain bar in a manner whereby when the disc is rotated by a tool in the accommodation slots in a manner whereby when the bar pin is given a forward thrust, the bar pin is moved thereby moving the chain bar to tighten the chain of the saw. When the bar pin is given a backward thrust, the bar pin is moved thereby permitting the chain bar to loosen the chain of the saw, by manual backward movement of the bar.

1 Claim, 7 Drawing Figures

CHAIN SAW BAR TIGHTENER

BACKGROUND OF THE INVENTION

The present invention relates to a chain saw bar tightener. More particularly, the invention relates to a chain saw bar tightener for a chain saw having a chain bar of substantially elongated plate-like configuration having elongated top and bottom edges with a groove formed therein for guiding a chain. The chain bar has front and back edges with a groove for guiding the chain and a slot extending into the chain bar substantially parallel to the top and bottom edges from the back edge. The chain saw also has a housing casting.

Objects of the invention are to provide a chain saw bar tightener of simple structure, which is inexpensive in manufacture, installed with facility and convenience on new and existing chain saws, and functions efficiently, effectively and reliably to selectively tighten and loosen the chain of a chain saw without the need for dismantling the saw.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 1:
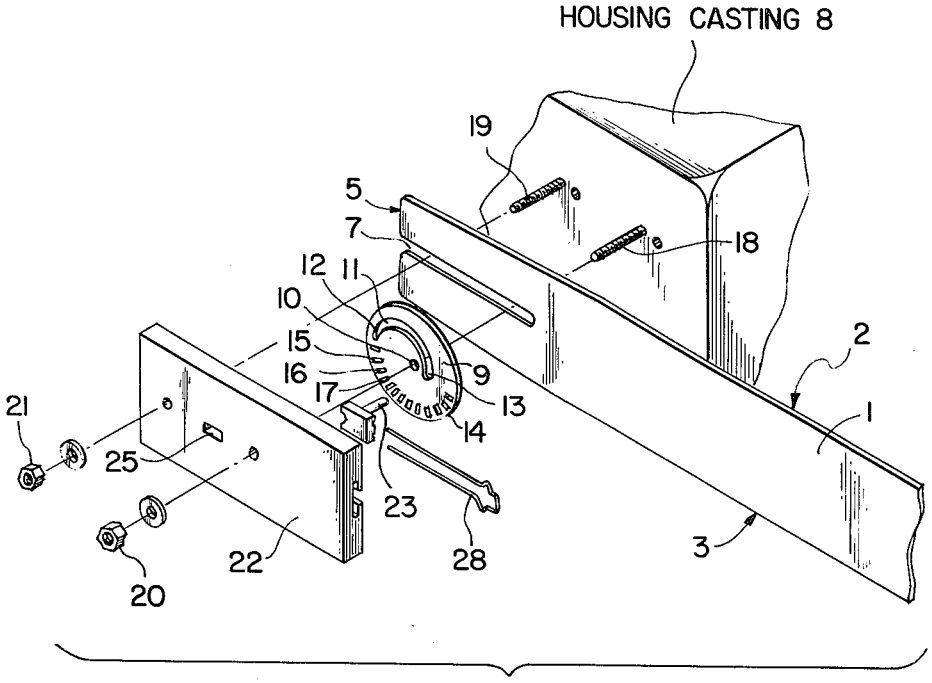
FIG. 1 is an exploded perspective view of an embodiment of the chain saw bar tightener of the invention.
Figure 2:
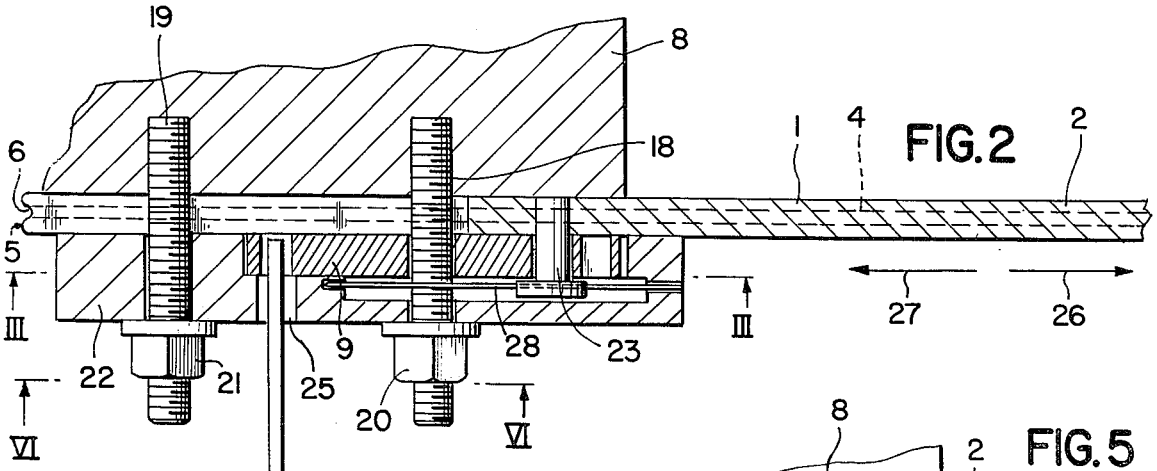
FIG. 2 is a view, partly in section, of the embodiment of FIG. 1.
Figure 5:
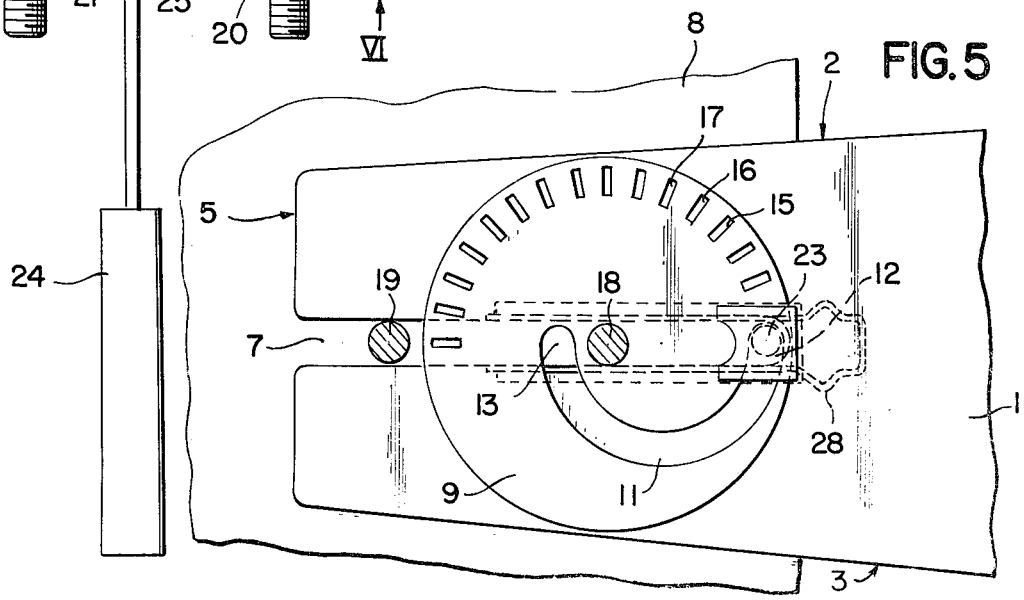
FIG. 5 is a view of the embodiment of FIG. 3 adjusted to tighten the chain of the saw to a greater extent than in FIG. 4.
Figure 3:
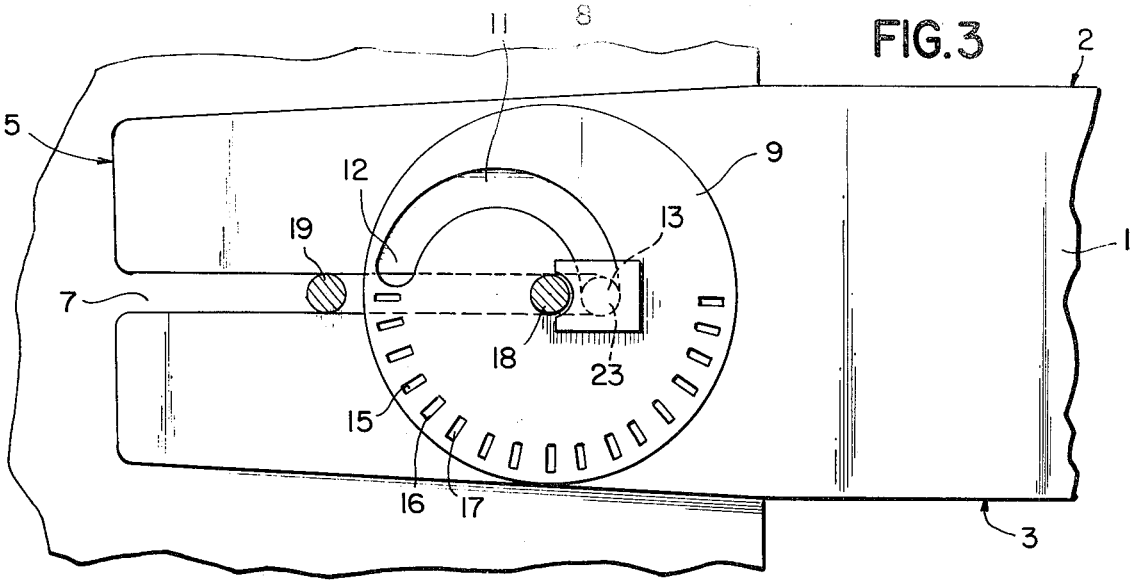
FIG. 3 is a view, partly in section, taken along the lines III—III, of FIG. 2.
Figure 4:
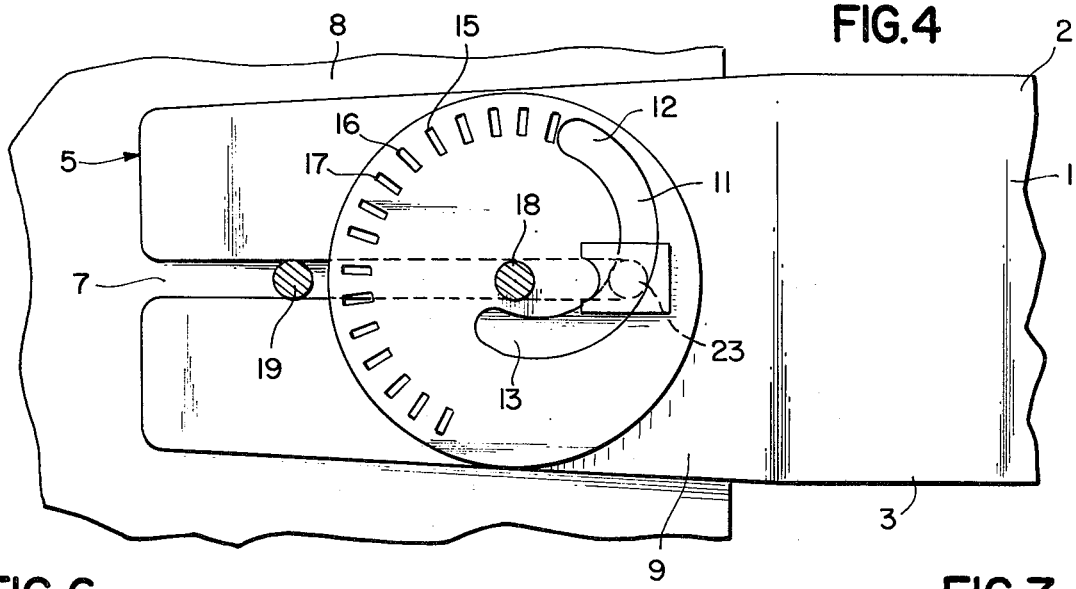
FIG. 4 is a view of the embodiment of FIG. 3 adjusted to tighten the chain of the saw.
Figure 6:
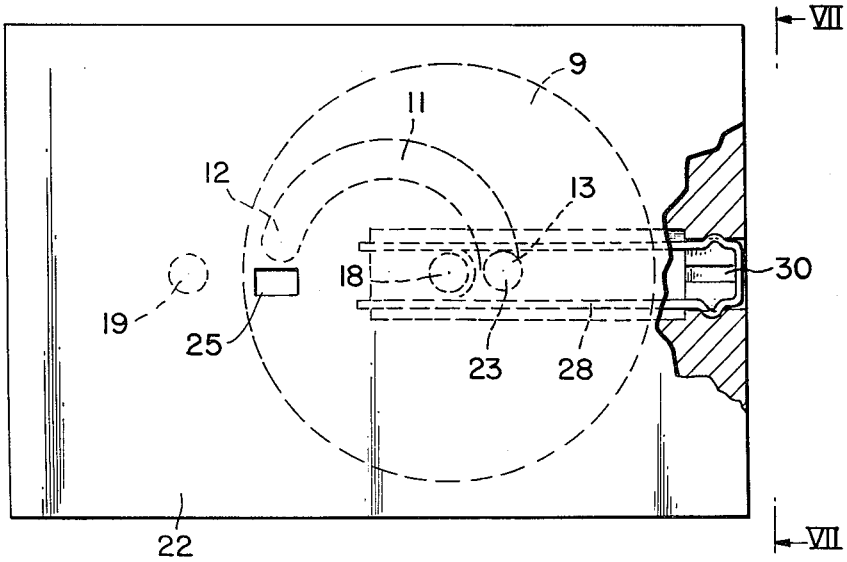
FIG. 6 is a partly cutaway, partly sectional view, taken along the lines VI—VI, of FIG. 2.
Figure 7:
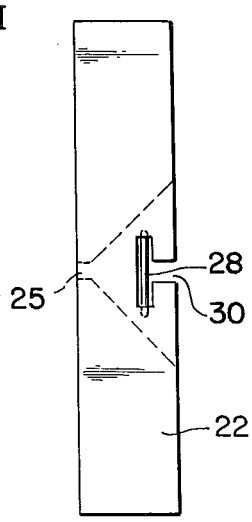
FIG. 7 is a view, taken along the lines VII—VII, of FIG. 6.

The chain saw bar tightener of the invention is for a chain saw having a chain bar 1 (FIGS. 1 to 5) of substantially elongated plate-like configuration having elongated top and bottom edges 2 and 3, respectively (FIGS. 1 and 3 to 5), with a groove formed therein for guiding a chain (not shown in the FIGS.). The groove 4 formed in the top edge 2 is shown in FIG. 2. The chain bar 1 has a front edge (not shown in the FIGS.) and a back edge 5 (FIGS. 1 to 5) with a groove for guiding the chain. The groove 6 formed in the back edge 5 is shown in FIG. 2. A slot 7 (FIGS. 1 and 3 to 5) extends into the chain bar 1 substantially parallel to the top and bottom edges 2 and 3 from the back edge 5. The chain saw also has a housing casting 8 (FIGS. 1, 2, 5).

The chain bar tightener of the invention comprises a disc 9 (FIGS. 1 to 6) having an axial bore 10 (FIG. 1) formed therethrough. A substantially semiannular slot 11 having a diameter smaller than that of the disc 9 is formed through said disc with its ends 12 and 13 substantially on a diameter of the disc, as shown in FIGS. 1 and 3 to 6. The semiannular slot 11 has one end 12 adjacent the circumference 14 (FIG. 1) of the disc and the other end 13 adjacent the axial bore 10 between said bore and a point diametrically opposite that adjacent the end 12 of the slot, as shown in FIGS. 1 and 2 to 6.

A plurality of spaced accommodation slots 15, 16, 17, and so on, extend radially in mutually spaced relation in the area of approximately half the circumference 14 of the disc 9 (FIGS. 1 and 3 to 5).

A disc mounting device comprising a stud 18 (FIGS. 1 to 6) passes through the axial bore 10 of the disc 9 and through the slot 7 of the chain bar 1 and is affixed to the housing casting 8 for rotatably mounting the disc for rotation about its axis. The stud 18 and a second stud 19 (FIGS. 1 to 6) and corresponding bolts 20 and 21 threadedly coupled to the studs 18 and 19, respectively (FIGS. 1 and 2), fasten a cover plate 22 (FIGS. 1, 2, 6 and 7) to the housing casting 8 with the chain bar 1 sandwiched between said housing casting and said cover plate, thereby securing said chain bar in position. The chain bar 1 is secured in position in an adjustable manner, since both studs 18 and 19 pass through the slot 7 thereof.

A bar pin 23 (FIGS. 1 to 6) passes through the semiannular slot 11 of the disc 9 and fits into the slot 7. Thus, when the disc 9 is rotated clockwise by a screwdriver 24 (FIG. 2) which is passed with an up and down motion through an access slot 25 formed through the cover plate 22 (FIGS. 1 and 2) into an accommodation slot 15, 16, 17, and so on, of the disc in a matter whereby the bar pin 23 is given a forward thrust, in the direction of an arrow 26 of FIG. 2, the bar pin is moved forward and thereby moves the chain bar 1 in the same direction of the arrow 26 to tighten the chain of the saw. When the screwdriver 24 is inserted into an accommodation slot 15, 16, 17, and so on, of the disc 9 and rotates the disc counterclockwise in the opposite direction, the bar pin 23 is given a backward thrust, in the direction of an arrow 27 of FIG. 2, and said bar pin is moved backward, thereby permitting the chain bar 1 to be moved in the direction of the arrow 27 to loosen the chain of the saw.

The disc slot 11 controls the movement of the bar pin 23.

A bar pin holder 28 is suitably mounted in the cover plate 22, as shown in FIGS. 1, 2, 5, 6 and 7.

The groove 6 is approximately ¼ inch deep to accommodate the saw chain. There is no clearance between the saw bar, the disc and the cover, since these parts must be solid and tight to prevent the disc from moving when the bolts 20 and 21 are tight. Since the disc cannot turn when the bolt nuts are tight, it is not necessary to tighten such nuts as much as other saws thereby preventing possible stripping of threads in engine castings, as the nuts are threaded. When the bolt nuts are loosened, all the components move easily. The components cannot move, however, when the nuts are tightened.

The bar pin 23 is clear at its head end. This is necessary, since the cover does not tighten properly if the bar pin is too long. However, there must be no clearance where the bar pin 23 fits into the disc slot, since this causes looseness of the chain bar. The bar pin 23 is securely fixed in the disc slot, it is impossible for the chain bar 1 to loosen, since the disc cannot rotate when the bolt nuts are tight.

The bar pin holder 28 functions only to keep the bar pin 23 from being lost when the cover is removed. The bar pin holder 28 maintains the bar pin 23 on the cover. The notches on the head of the bar pin holder keep the holder in place, and the holder retains the bar pin in turn. When the cover is removed, the bar pin 23 is easily removed by prying the bar pin holder 28 out of the cover casting with a screwdriver, opening as shown at 30.

The bar pin holder may easily be pried out for cleaning, yet will prevent the bar pin from being lost, even with rough usage. The studs for tightening the cover are very easy to reach. The access slot 25 permits the tightening adjustment of the chain.

The chain saw bar tightener of the invention is practical. The chain will not loosen in use, since the disc cannot turn when the nuts are tight. The accommodation or adjusting slots of the invention are easily accessible for adjustment. The bar pin of the invention is readily and rapidly removable by the slipping out of the bar pin holder for cleaning the bar pin head groove.

The chain saw bar tightener of the invention has many advantages and is practical in use. The chain will not loosen after use, since the disc cannot turn when the nuts are tight. The accommodation or adjusting slots in the disc are easily accessible and positive in adjusting chain tension. The nuts do not have to be overly tight to hold the chain adjustment, thus preventing thread stripping.

While the invention has been described by means of a specific example and in a specific embodiment, I do not wish to be limited thereto, for obvious modifications will occur to those skilled in the art without departing from the spirit and scope of the invention.

I claim:

1. A chain saw bar tightener for a chain saw having a chain bar of substantially elongated plate-like configuration having elongated top and bottom edges with a groove formed therein for guiding a chain, front and back edges with a groove for guiding the chain and a slot extending into the chain bar substantially parallel to the top and bottom edges from the back edge, and a housing casting, said chain saw bar tightener comprising a disc having an axial bore therethrough, a substantially semiannular slot having a diameter smaller than that of the disc formed through the disc with its ends substantially on a diameter of the disc, the semiannular slot having one end adjacent the circumference of the disc and the other end adjacent the axial bore between said bore and a point diametrically opposite that adjacent the one end of the slot, and a plurality of spaced accommodation slots extending radially in mutually spaced relation in the area of approximately half the circumference of the disc;

disc mounting means for rotatably mounting the disc for rotation via a stud passing through the slot of the chain bar and affixed to the housing casting; and a bar pin passing through the semiannular slot of the disc and into the chain bar slot in a manner whereby when the disc is rotated by a tool in the accommodation slots of the disc in a manner whereby when the bar pin is given a forward thrust, said bar pin is moved forward thereby moving the chain bar to tighten the chain of the saw and when said bar pin is given a backward thrust, said bar pin is moved backward thereby permitting the chain bar to loosen the chain of the saw.

* * * * *